US006996359B2

(12) United States Patent
Awaya

(10) Patent No.: US 6,996,359 B2
(45) Date of Patent: Feb. 7, 2006

(54) IMAGE FORMING APPARATUS

(75) Inventor: Tetsuro Awaya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/793,791

(22) Filed: Mar. 8, 2004

(65) Prior Publication Data

US 2004/0223788 A1 Nov. 11, 2004

(30) Foreign Application Priority Data

Mar. 10, 2003 (JP) ..... 2003-063385

(51) Int. Cl.
*G03G 15/01* (2006.01)

(52) U.S. Cl. ..... 399/227; 399/258; 399/256

(58) Field of Classification Search ..... 399/226, 399/227, 254, 256, 258, 223, 85
See application file for complete search history.

(56) References Cited

U.S. PATENT DOCUMENTS

| | | | | |
|---|---|---|---|---|
| 5,565,973 | A | 10/1996 | Fujishiro et al. | 355/326 R |
| 5,940,664 | A * | 8/1999 | Sugihara et al. | 399/227 |
| 6,122,469 | A * | 9/2000 | Miura et al. | 399/227 |
| 6,184,909 | B1 * | 2/2001 | Matsuno et al. | 347/115 |
| 6,192,211 | B1 * | 2/2001 | Kimura | 399/227 |
| 6,748,188 | B2 * | 6/2004 | Kishigami et al. | 399/227 |
| 6,839,533 | B2 * | 1/2005 | Ban et al. | 399/260 |
| 2004/0126142 | A1 * | 7/2004 | Toba et al. | 399/227 |
| 2004/0179865 | A1 * | 9/2004 | Nishiyama | 399/254 |

FOREIGN PATENT DOCUMENTS

| | | |
|---|---|---|
| JP | 8-44183 | 2/1996 |
| JP | 10-198144 | 7/1998 |

* cited by examiner

*Primary Examiner*—Christopher W. Fulton
*Assistant Examiner*—Amy R. Cohen
(74) *Attorney, Agent, or Firm*—Fitzpatrick, Cella, Harper & Scinto

(57) ABSTRACT

An image forming apparatus includes a first developing device and a second developing device for developing an electrostatic latent image formed on an image bearing member and a developing portion; a rotatable member supporting the first and second developing devices, the rotatable member being rotatable along a path through the developing portion; a first developer supply container and a second developer supply container, supported on the rotatable member, for supplying developer into the first developing device and into the second developing device; wherein the developer in the first developer supply container is fed using rotation of the rotatable member, whereas the developer in the second developer supply container is fed without using rotation of the rotatable member.

12 Claims, 11 Drawing Sheets

IMAGE FORMING APPARATUS

FIELD OF THE INVENTION AND RELATED ART

The present invention relates to an image forming apparatus employing an electrophotographic, electrostatic, or the like recording method. In particular, it relates to such an image forming apparatus as a copying machine, a printer, a facsimile machine, and a multifunction image forming apparatus capable of performing two or more of the functions of the preceding apparatuses.

Developer in the form of particulates has long been used as the developer for an image forming apparatus such as an electrophotographic copying machine, a printer, etc. As the amount of the developer in the main assembly of an image forming apparatus is reduced to a critical level by consumption, a developer supply container is used to supply the image forming apparatus with developer. Developer is in the form of extremely small particulates, creating therefore the problem that when an operator supplies the image forming apparatus with developer, developer scatters, contaminating the adjacencies thereof. Thus, various methods for preventing this problem have been proposed or put to practical use. According to some of them, a developer supply container is placed in the main assembly of an image forming apparatus, and the developer in the container is discharged in increment from the small outlet of the container. In the case of this type of method, it is rather difficult to automatically discharge the developer using only the natural force, more specifically, gravity. In other words, some type of means is necessary for conveying the developer in the container while stirring the developer.

Generally, when forming a multicolor image, a plurality of images different in color are sequentially formed of toners different in color, one for one, on a photosensitive member, and are sequentially, or all at once, transferred in layers onto transfer medium such as a piece of paper. More concretely, referring to FIGS. 13 and 14, an image forming apparatus capable of forming a multicolor image as described above, generally employs one of the so-called rotary developing methods, and comprises a plurality of developing devices, for example, black 311K, yellow 311Y, magenta 311M, and cyan 311C developing devices, which are mounted in a rotary rotatable to sequentially move, as necessary, into the position in which they face the photosensitive member for development. As for this image forming method, or the so-called rotary development method, various methods have been proposed, and some of them have been put to practical use.

Next, referring to FIGS. 9–15, the structure of a rotary developing apparatus in accordance with the prior art will be described.

Referring to FIGS. 9 and 10, Japanese Laid-open Patent Application 10-198144, for example, discloses one of such developer supply containers. In the case, each of a plurality of developer supply containers 10 is provided with a pair of spiral agitators 88, which are located within the container 10, and are rotatable to convey the developer in the container 10 toward the developer outlet located at one of the lengthwise ends of the container 10 and discharge the developer from the outlet.

Next, referring to FIGS. 11–15, each of the developer supply containers 315 disclosed in Laid-open Patent Application 8-44183 is provided with a plurality of ridges 333, which are located within the container 315 to guide the developer toward the developer outlet 327. The developer supply containers 322 are stationarily attached to a rotary type developing apparatus 300. Thus, as the rotary 300 is rotated, each developer supply container 315 is orbitally moved about the rotational axis of the rotary 300, and as the developer container 315 is orbitally moved, the developer therein is conveyed to the outlet 319 of the container 315, being thereby discharged into the development chamber of the corresponding developing apparatus, by the plurality of ridges in the containers 315.

The above described developer supply containers in accordance with the prior art, however, had the following problems.

The developer supply container disclosed in Japanese Laid-open Patent Application 10-198144 requires a mechanism for rotationally driving the agitators, in addition to the agitators. In other words, it is greater in component count, being higher in cost. Further, the frame of the developer supply container must be provided with bearings for the agitators, and the bearings must be provided with some type of seal for preventing the developer in the container from leaking. This adds to the cost of a developer supply container. Thus, in consideration of the fact that the rotary developing apparatus in accordance with the prior art comprises a plurality of interchangeably structured developer supply containers, and also a plurality of interchangeably structured developing devices, the effect of this structural arrangement upon the overall cost of the rotary developing apparatus is substantial.

On the other hand, in the case of the developer supply container disclosed in Japanese Laid-open Patent Application 8-44183, the developer in the developer supply container is not supplied to the developing device when the developing device is in the development position. Thus, if a substantial number of high density monochromatic images are continuously formed, the image forming operation has to be temporarily stopped to rotate the rotary to supply the active developing device with developer. This substantially reduces image formation productivity. Currently, the frequency with which a full-color image forming apparatus is used for continuously forming a substantial number of monochromatic images is rather high. Therefore, the reduction in productivity in continuous monochromatic image formation is rather difficult for users to tolerate.

To sum up, the structural arrangements, in accordance with the prior art, for a rotary developing apparatus suffer from the following problems. That is, providing each of the developer supply containers used with a rotary developing apparatus, with developer conveying internal members which must be rotationally driven, substantially increases the cost of a rotary developing apparatus. On the other hand, structuring a rotary developing apparatus to use the rotation of the rotary of the developing apparatus to discharge the developer from each of the developer supply containers, drastically reduces the productivity with which a substantial number of monochromatic images are continuously formed.

SUMMARY OF THE INVENTION

The primary object of the present invention is to provide an image forming apparatus satisfactory in terms of both apparatus cost and productivity.

Another object of the present invention is to provide an image forming apparatus satisfactory in terms of both the reduction in apparatus cost and the increase in productivity in monochromatic image formation.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 8:
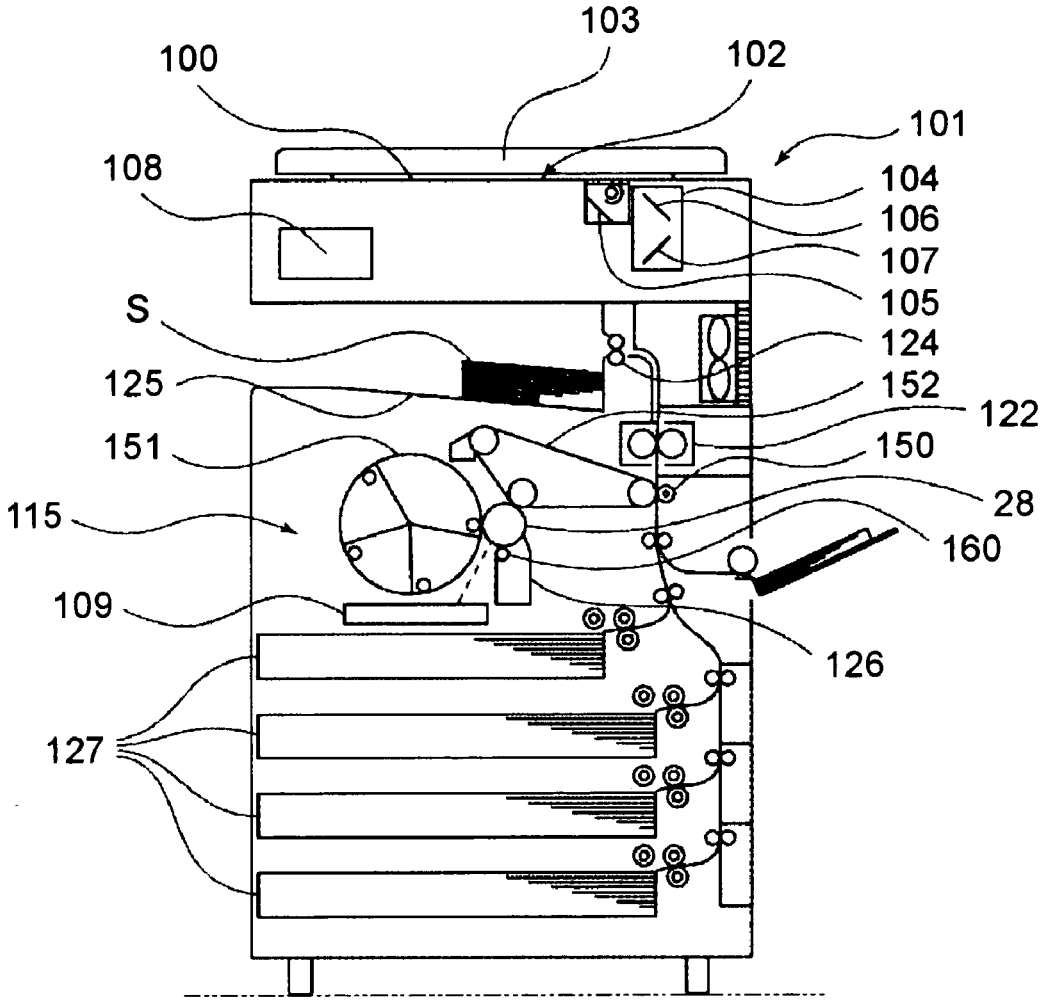
FIG. 8 is a schematic sectional view of a typical image forming apparatus compatible with a developing apparatus in accordance with the present invention.
Figure 9:
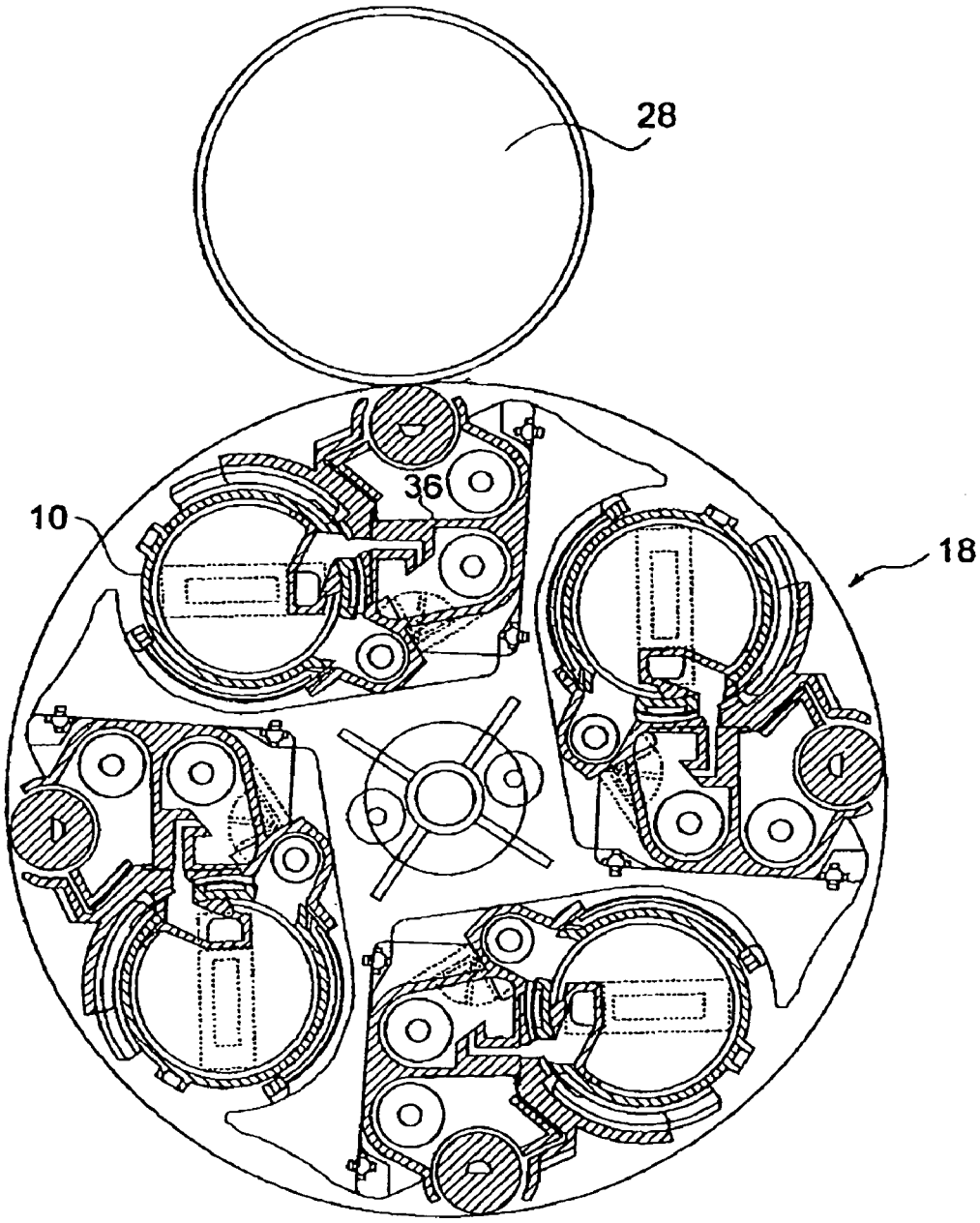
FIG. 9 PRIOR ART
FIG. 9 is a cross-sectional view of a developing apparatus in accordance with the prior art.
Figure 10:
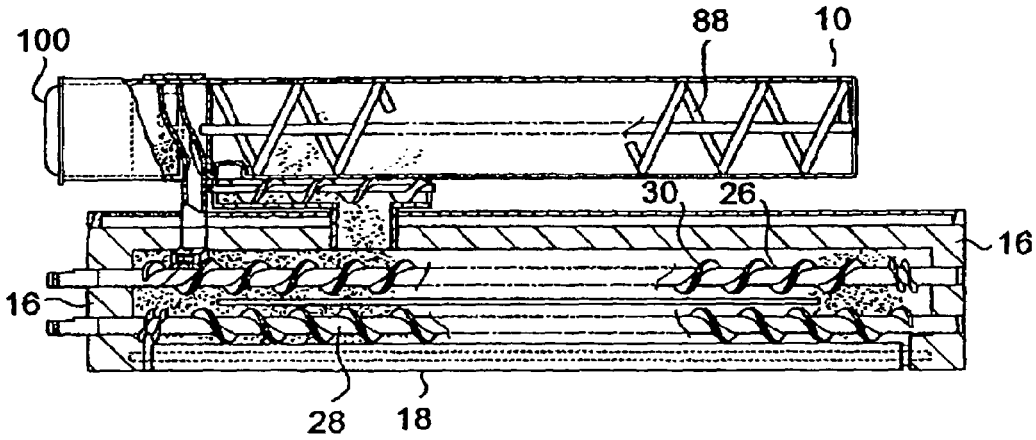
FIG. 10 PRIOR ART
FIG. 10 is a lengthwise sectional view of the developing apparatus in accordance with the prior art.
Figure 11:
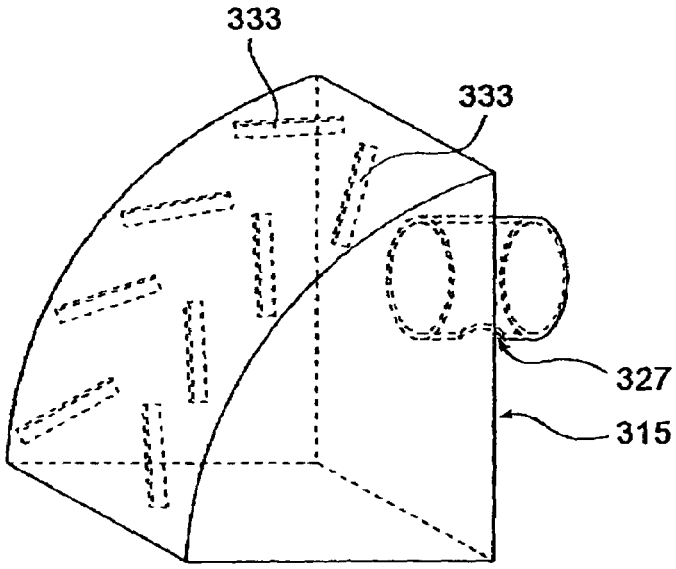
FIG. 11 PRIOR ART
FIG. 11 is a perspective phantom view of the developer supply container of the developing apparatus in accordance with the prior art.
Figure 12:
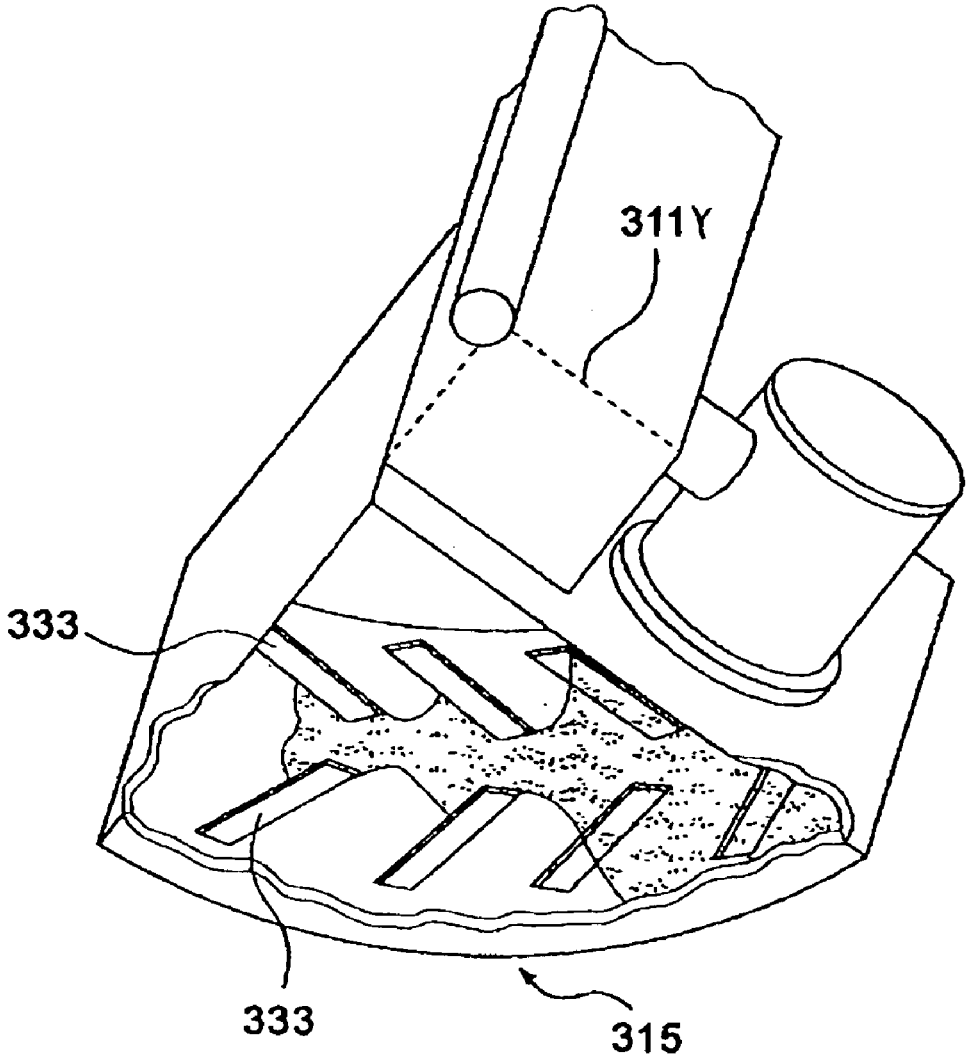
FIG. 12 PRIOR ART
FIG. 12 is a partially broken perspective view of the developer supply container of the developing apparatus in accordance with the prior art.
Figure 13:
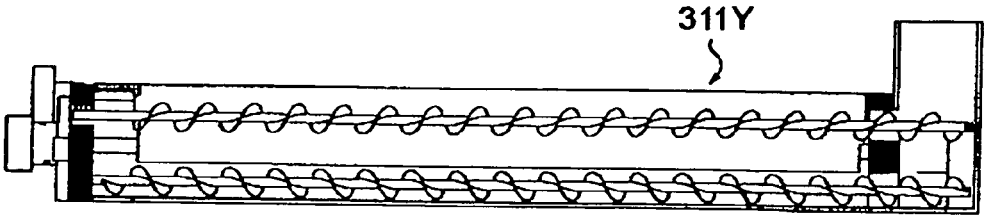
FIG. 13 PRIOR ART
FIG. 13 is a lengthwise sectional view of the developer supply container of the developing apparatus in accordance with the prior art.
Figure 14:
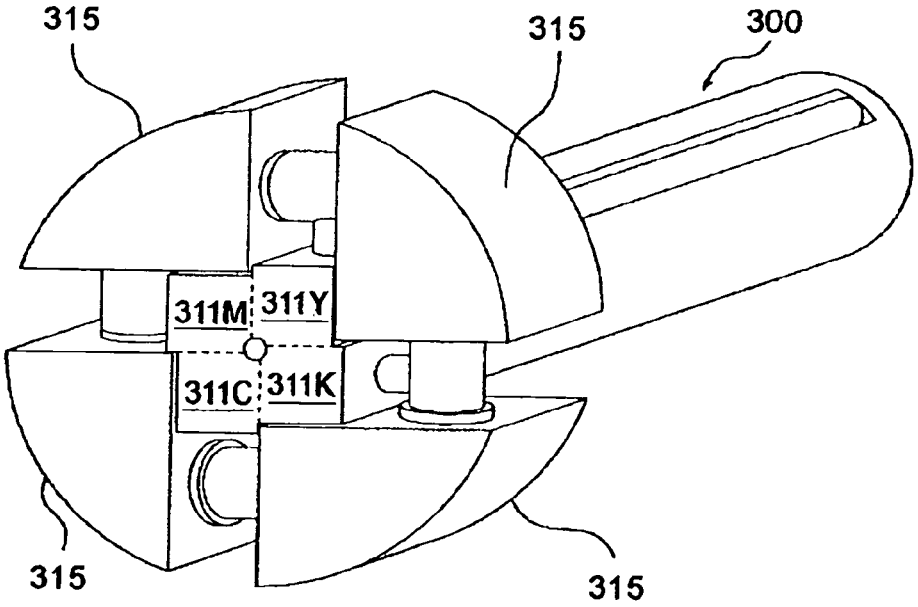
FIG. 14 PRIOR ART
FIG. 14 is a perspective view of the developing apparatus in accordance with the prior art.
Figure 15:
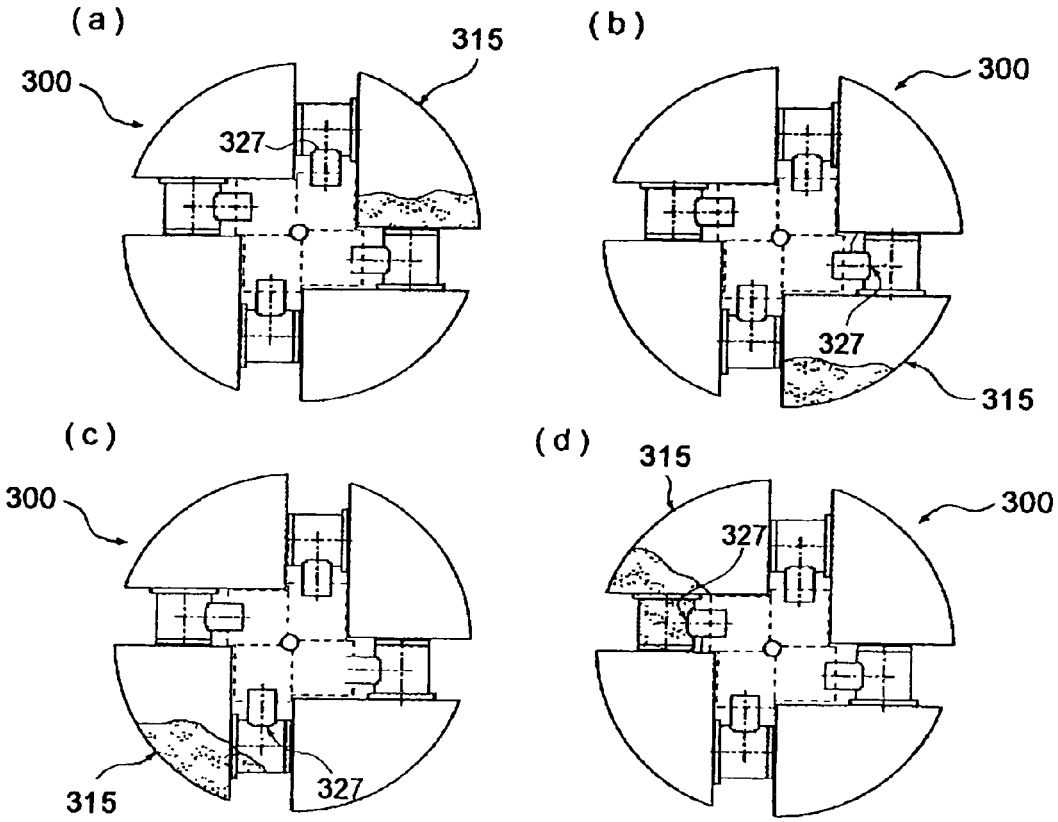
FIG. 15 PRIOR ART
FIG. 15 is a cross-sectional view of the developing apparatus in accordance with the prior art.

First, a typical image forming apparatus compatible with a developing apparatus in accordance with the present invention will be described with reference to the appended drawings. FIG. 8 is a sectional view of the image forming apparatus compatible with the developing apparatus in accordance with the present invention.

Designated by a referential number 101 is the main assembly of the image forming apparatus. The main assembly 101 has an original holding platen 102, which is formed of transparent glass plate and is solidly attached to the top of the image forming apparatus main assembly 101. Designated by a referential number 103 is an original pressing plate for keeping an original 100 flatly pressed on the original holding platen 102 after the original 100 is placed on the original holding platen 102, with the image bearing side of the original 100 facing downward. Located below the original holding platen 102 is an optical system comprising: a lamp 104 for illuminating the original 100; reflection mirrors 105, 106 and 107 for guiding the optical image of the illuminated original 100 to an image processing unit 108; etc. The optical system (lamp 104, reflection mirrors 105, 106, and 107, etc.) is moved at a predetermined speed to scan the original 100.

Designated by a referential number 115 is the image formation station, which comprises: a photosensitive drum 28 as an image bearing member; a charge roller 160 for uniformly charging the peripheral surface of the photosensitive drum 28; a rotary development unit 151 for forming an image of toner (toner image), on the photosensitive drum 28; an intermediary transfer belt 152 onto which the toner formed on th peripheral surface of the photosensitive drum 28 through development is transferred; a transfer roller 150 for transferring the toner image on the intermediary transfer belt 152, onto a sheet S; a cleaner 126 for removing the toner particles remaining on the photosensitive drum 28 after the transfer of the toner image; etc. As for the image formation process, first, the peripheral surface of the photosensitive drum 28 is charged by the charge roller 160, and the charged peripheral surface of the photosensitive drum 28 is exposed to an optical image projected from a laser unit 109, creating thereby an electrostatic latent image on the peripheral surface of the photosensitive drum 28. The electrostatic latent image is developed into an image formed of toner, and the image formed of toner is transferred onto the intermediary transfer belt 152. Then, the toner image on the intermediary transfer belt 152 is transferred by the transfer roller 150 onto the sheet S. The sheet S is supplied from a sheet cassette 127.

On the downstream of the image formation station 115, there are a fixing device 122 and a pair of discharge rollers 124, which are disposed in this order. The fixing device 122 is for fixing the toner image on the sheet S, to the sheet S, to create a permanent image, while the sheet S is conveyed through the fixing device. The discharge rollers 124 are for discharging the sheet S from the main assembly 101 of the copying machine, after the fixation of the toner image to the sheet S in the fixing device 122. Attached to the exterior of the copying machine main assembly 101 is a delivery tray 125 which catches the sheet S as it is discharged from the main assembly 101 by the pair of discharge rollers 124.

Figure 1:
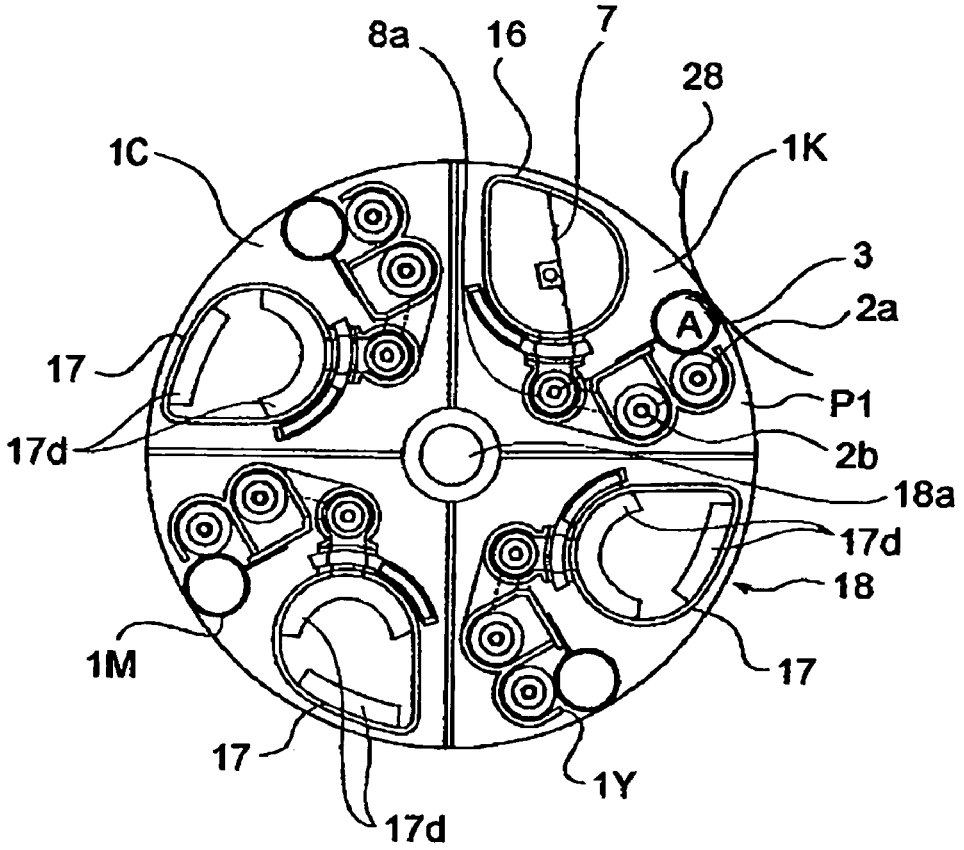
FIG. 1 is a cross-sectional view of the developing apparatus in the first embodiment of the present invention.

Next, the image forming apparatus employing a rotary development method will be described. Referring to FIG. 1, a rotary 18 holds a plurality of developing devices 1K, 1Y, 1M, and 1C, and can be rotated by rotationally driving the center shaft 18*a* of the rotary by an unshown motor. In order to form a black toner image on the photosensitive drum 28, the rotary 18 is rotated to move the developing device 1K into the development position P1 in which the developing device 1K is placed virtually in contact with the photosensitive drum 28, for development, whereas in order to form a toner image different in color from the toner image formed with the use of the developing device K1, for example, a yellow toner image, the rotary 18 is rotated again to move the developing device Y1 into the development position P1 for development. The toner images different in color from the images formed by the developing devices 1K and 1Y are formed in the same manner.

(Embodiment 1)

Figure 2:
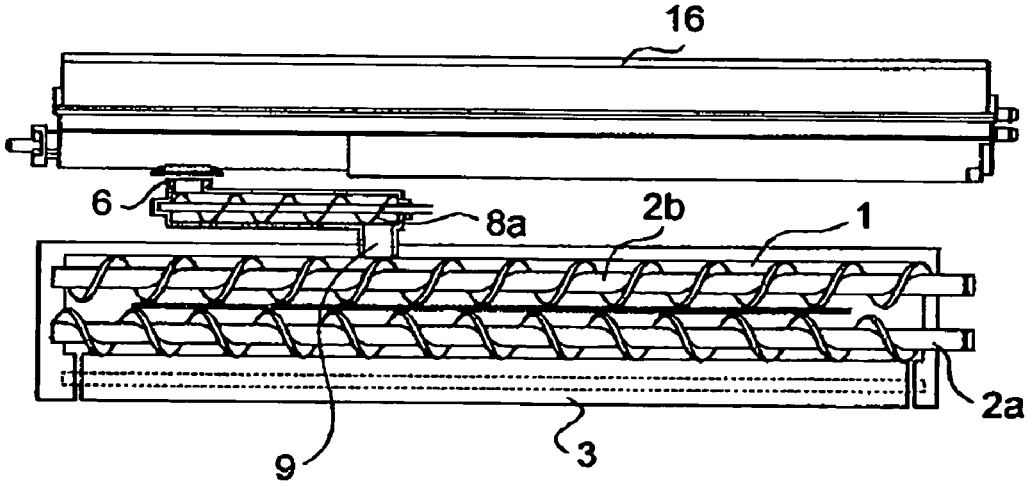
FIG. 2 is a lengthwise sectional view of the developing apparatus in the first embodiment of the present invention.
Figure 3:
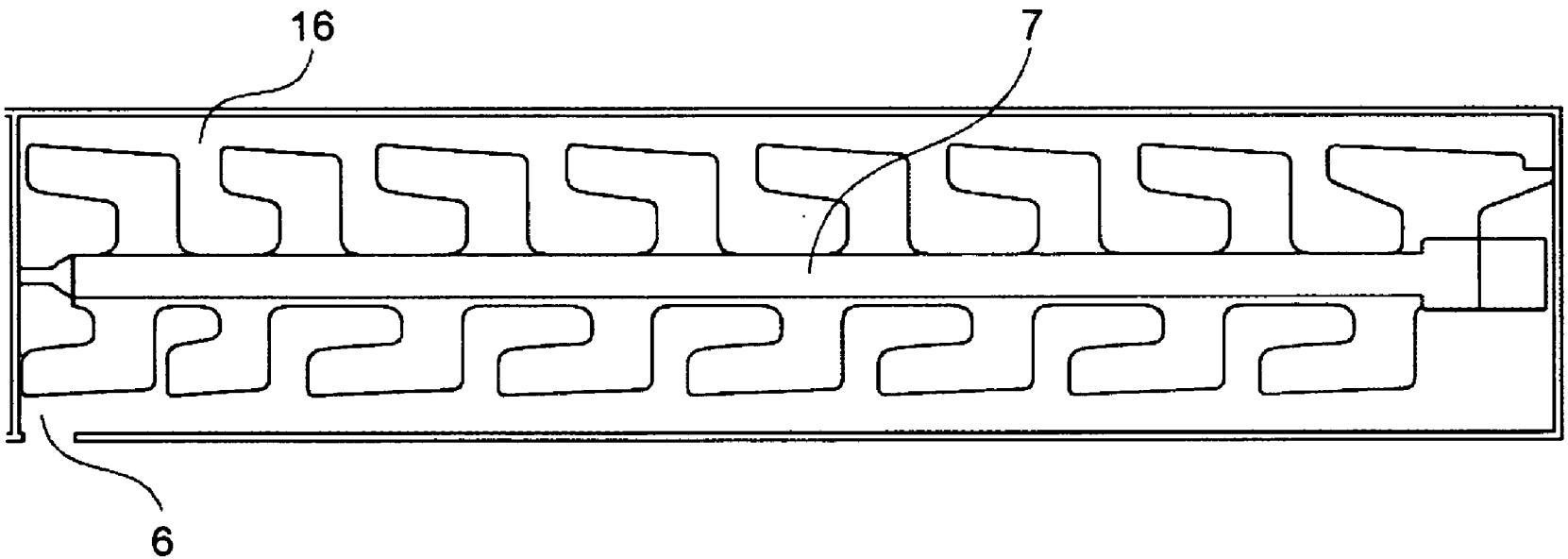
FIG. 3 is a lengthwise sectional view of the developer supply container, in the first embodiment of the present invention, having no internal member for conveying developer while stirring.
Figure 4:
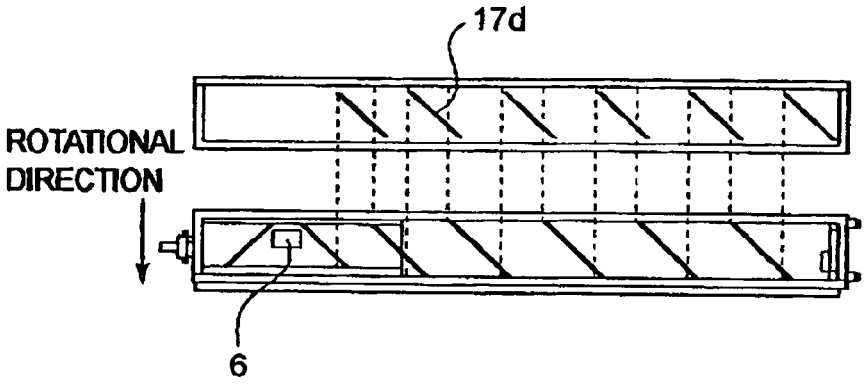
FIG. 4 is a plan view of the inward sides of the top and bottom halves of the developing supply container, in the first embodiment of the present invention, having no developer stirring-conveying internal member, as seen from the directions toward which the molds therefor are removed.
Figure 5:
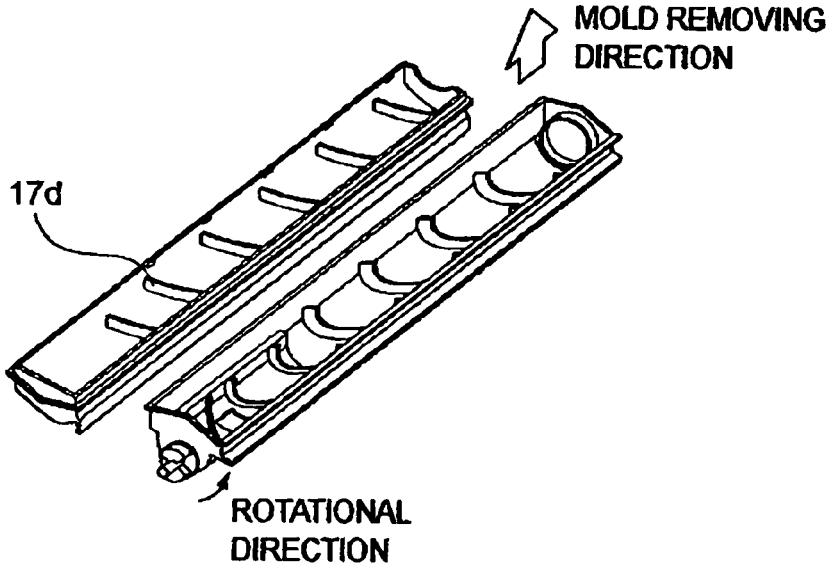
FIG. 5 is a perspective view of the inward sides of the top and bottom halves of the developer supply container, in the first embodiment of the present invention, having no developer stirring-conveying internal member, showing the structures thereof.

Hereinafter, referring to FIGS. 1–5, the first embodiment of the present invention will be described. FIG. 1 is a lengthwise sectional view of the developing apparatus in the first embodiment of the present invention, and FIG. 2 is a cross-sectional view of the developing device in the first embodiment. FIG. 3 is a lengthwise sectional view of the developer supply container having an internal member for conveying the developer in the container while stirring the developer, in the first embodiment, and FIG. 4 is a plan view of the inward sides of the top and bottom halves of the developing supply container, in the first embodiment of the present invention, having no developer stirring-conveying internal member, as seen from the directions toward which the molds therefor are removed. FIG. 5 is a perspective view of the inward sides of the top and bottom halves of the developer supply container, in the first embodiment of the present invention, having no developer stirring-conveying internal member, showing the structures thereof.

In each of the developing devices 1, developer which essentially is a mixture of nonmagnetic toner and magnetic carrier is stored. The initial toner content of the developer is roughly 8% in weight. The initial toner content is to be adjusted in accordance with the amount of toner charge, diameter of carrier, structure of an image forming apparatus, etc. In other words, it is not mandatory that the initial toner content is this value of 8%.

Each developing device 1 has a development opening which faces the photosensitive drum 28. In the developing device 1, a development sleeve 3 as a developer carrying member is rotationally disposed, being partially exposed to the photosensitive drum 28 through the development opening. During development, the development sleeve 3 is rotated in the direction indicated by an arrow mark A shown in FIG. 1, and as it is rotated, the two-component developer in the developing device 1 is borne in a layer on the peripheral surface of the developing device 1, and is conveyed to the development opening, where the peripheral surface of the development sleeve 3 of the developing device 1 and the peripheral surface of the photosensitive drum 28 come virtually in contact with each other. In the development area, the two-component developer on the peripheral surface of the development sleeve 3 of the developing device 1 is supplied to the portion of the peripheral surface of the photosensitive drum 28, which is facing the development sleeve 3, developing the electrostatic latent image on the photosensitive drum 28. After the development of the electrostatic latent image on the photosensitive drum 28, the two-component developer remaining on the photosensitive drum 28 is further conveyed by the rotation of the development sleeve 3, and recovered into the developing device 1. In the developing device 1, the two-component developer is circulated, while being stirred and mixed, within the developing device 1 by a first developer circulation screw 2*a* (screw closer to development sleeve 3), and a second developer circulation screw 2*b* (screw farther from development sleeve 3). As for the developer circulation direction, the developer is moved from the front toward the back of the drawing by the first developer circulation screw 2*a*, and from the back toward the front by the second developer circulation screw 2*b*. The image forming apparatus is structured so that the development sleeve 3, first developer circulation screw 2*a*, and second development circulation screw 2*b* become connected to the image forming apparatus main assembly to receive rotational driving force, only when the developing device 1 to which they belong is in the development position.

A developer supply container 16 as a developer container is placed above the developing device 1, and stores the developer supply. It contains a developer stirring-conveying member 7 for conveying the developer in the developer supply container 16 toward the developer outlet 6. The developer stirring-conveying member 7 comprises a rigid shaft and plural pieces of resin film attached to the rigid shaft, so that as the rigid shaft is rotationally driven, the developer in the developer supply container 16 is conveyed toward the developer outlet 6 while being stirred. There is an unshown seal between the developer supply container 16 and developing device 1, preventing the developer from leaking. Also, only when the developing device 1 is in the development position, the developer stirring-conveying member 7 becomes connected to the image forming apparatus main assembly to receive rotational driving force.

As the developing device 1 which takes the developer supply container 16 runs short of developer, it is replenished with developer in the following manner. That is, as the developing device 1 moved into the development position P1, the developer supply container 16 becomes connected to an unshown driving mechanism, causing the developer stirring-conveying member 7 to be rotated. As the developer stirring-conveying member 7 is rotated, the developer in the developer supply container 16 is conveyed to the developer outlet 6 of the developer supply container 16, and is discharged therefrom. The discharged developer falls, due to its own weight, onto the conveyance screw 8*a*, which is being rotated. As the result, the developer is conveyed by the conveyance screw 8*a* into the developing device 1 through the developer inlet 9 of the developing device 1, replenishing the developing device 1 with the developer. In other words, the developer supply container 16 is different from the developer supply container 17 in that the developer in the developer supply container 16 can be discharged from its outlet 6 without relying on the rotation of the rotary 18.

As for the developer supply container 17 which contains the developer supply, it is also positioned above the developing device 1. It is provided with a two sets of developer conveyance ridges 17*d* as a developer conveying means for conveying the developer in the developer supply container 17 toward the developer outlet 6. The two sets of developer conveyance ridges 17*d* are on the internal surfaces of the developer supply container 17, being separated from each other, in terms of the circumferential direction of the developer supply container 17. Each of the developer conveyance ridges 17*d* is tilted as shown in the drawing.

Thus, as the rotary 18 is rotated, the angle of each ridge 17*d* in the developer supply container 17 relative to the gravity direction, and the direction in which the gravity acts on a given point of each developer particle changes. Therefore, the developer in the developer supply container 17 is conveyed, while being stirred, toward the developer outlet 6, and discharged therefrom. There is an unshown sealing member between the developer supply container 17 and developing device 1, preventing the developer from leaking.

As the developing device 1 which takes the developer supply container 17 runs short of developer, it is replenished with developer in the following manner. That is, in order to replenish the developing device 1 with a fresh supply of developer from the developer supply container 17, the rotary 18 must be rotated. As the rotary 18 is rotated, the developer in the developer supply container 17 is conveyed, while being stirred, to the developer outlet 6 of the developer supply container 17, and is discharged therefrom. The discharged developer falls, due to its own weight, onto the conveyance screw 8*a*, which is being rotated. As the result, the developer is conveyed into the developing device 1 through the developer inlet 9 of the developing device 1, replenishing the developing device 1 with the fresh supply of developer.

Referring to FIG. 1, the developer supply container 16 in which the above described developer stirring-conveying member is disposed is structured that it can be coupled only with the developing device 1K (storing black toner, that is, achromatic toner, and used for forming black toner image) among the plurality of developing devices 1 in the rotary 18, (developing device 1K may be structured to be supplied with carrier in addition to black toner).

The developer supply container 17 which uses the rotation of the rotary 18 to discharge the developer is employed as the developer supply container for the developing devices 1 other than the developing device 1K, that is, the developing devices 1 for forming a chromatic image: developing device 1Y (which stores yellow toner and forms yellow toner image), developing device 1M (which stores magenta toner and forms magenta toner image, and developing device 1C (which stores cyan toner and forms cyan toner image). However, the four developing devices are identical as far as the basic structure is concerned (developing devices 1Y, 1M, and 1C may be structured to also be supplied with carrier in addition to chromatic toner).

The employment of the above described structural arrangement makes it possible to eliminate the developer stirring-conveying member, bearings, seal, etc., which add to the cost of a developer supply container, from three of the developer supply containers out of four developer supply containers described above, reducing thereby the cost of a rotary developing apparatus. Thus, it reduces overall image formation cost. Further, the developer supply container 16 is provided with the internal developer stirring-conveying member, which makes it possible to replenish the developing device 1K with developer while the developing device 1K is in the development position. Therefore, even during such an image formation job that requires a substantial number of black images of high density to be continuously formed, the rotary does not need to be rotated; the job can be handled without reducing image formation productivity.

In other words, this embodiment can satisfy both of the aforementioned two objects: reducing the cost of a rotary developing apparatus, and improving an image forming apparatus employing a rotary developing apparatus, in productivity in the continuous formation of a substantial number of black images.

(Embodiment 2)

Figure 6:
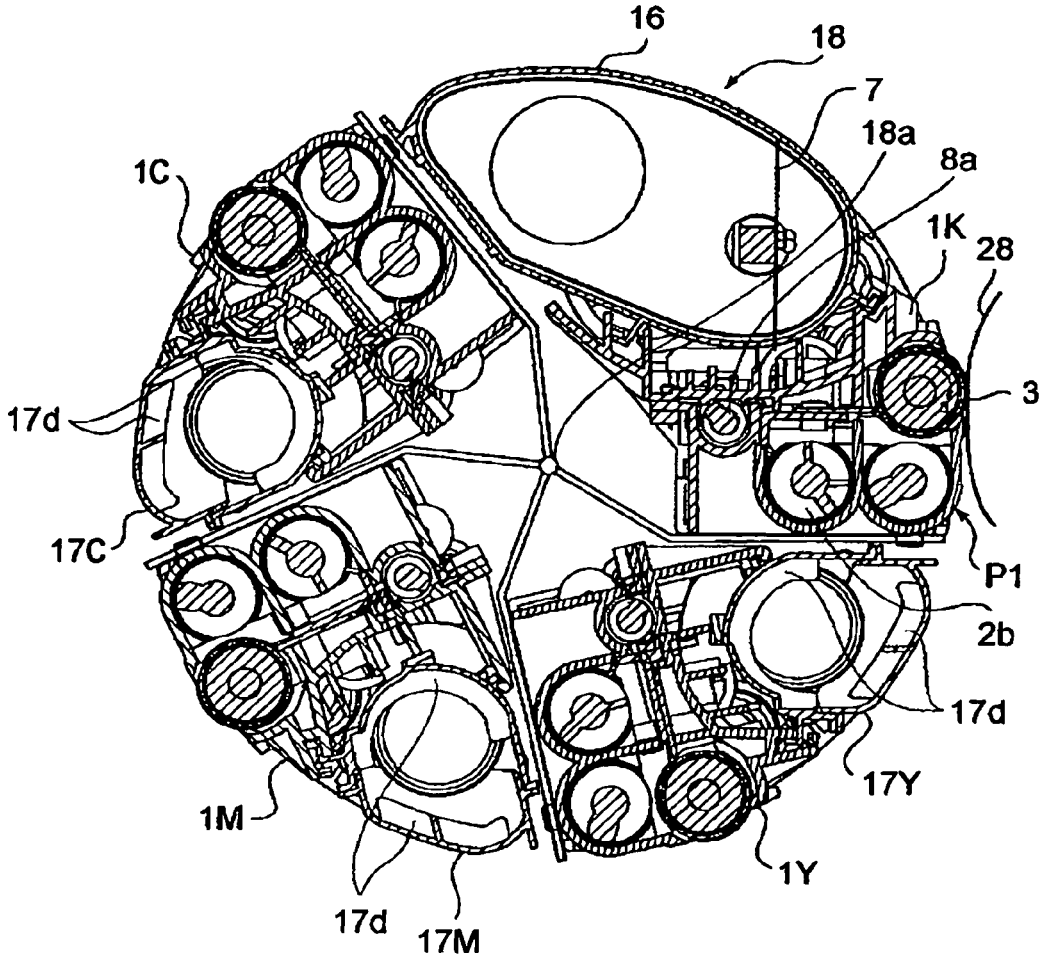
FIG. 6 is a cross-sectional view of the developing apparatus in the second embodiment of the present invention.
Figure 7:
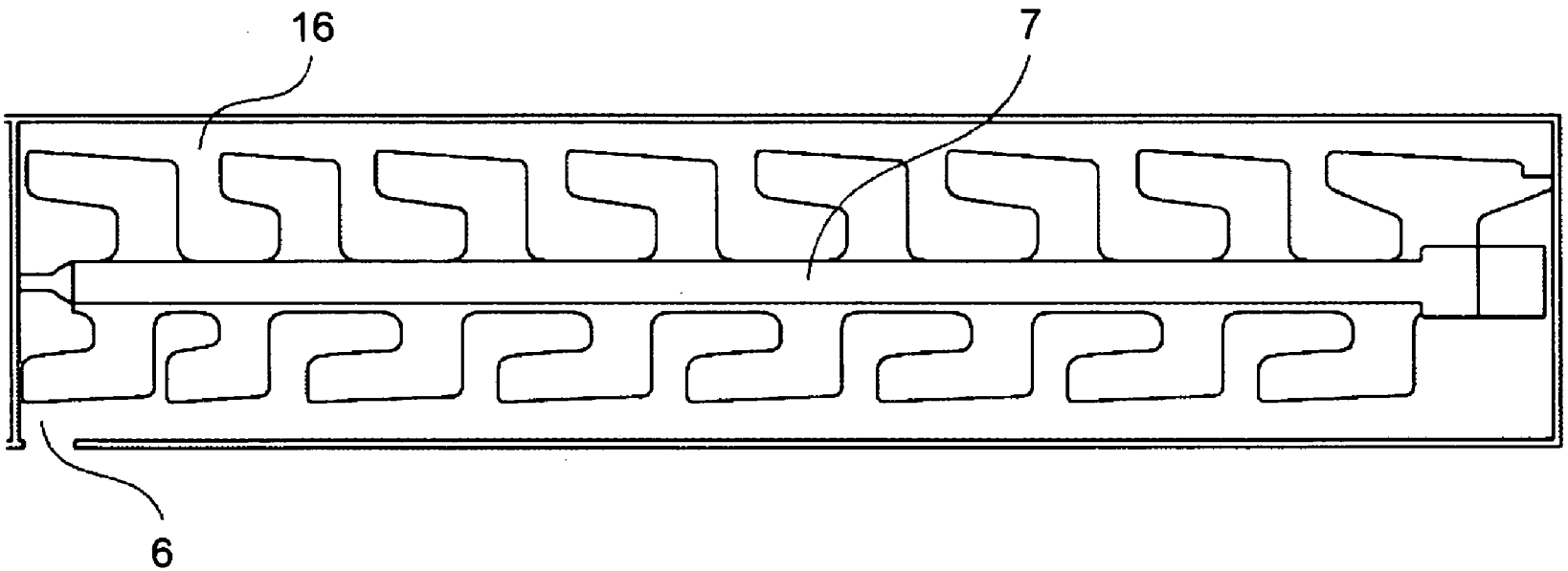
FIG. 7 is a lengthwise sectional view of the developer supply container having an internal member for conveying developer while stirring, in the second embodiment of the present invention.

Next, referring to FIGS. 6 and 7, the second embodiment of the present invention will be described. FIG. 6 is a cross-sectional view of the developing apparatus in the second embodiment of the present invention, and FIG. 7 is a lengthwise sectional view of the developer supply container, in the second embodiment, having an internal developer stirring-conveying member.

This embodiment is similar in many respects to the first embodiment. Therefore, it will be described regarding only the characteristic aspects thereof.

First, the image forming apparatus compatible with the rotary developing apparatus in this embodiment will be described. Referring to FIG. 1, a rotary 18 holds a plurality of developing devices 1K, 1Y, 1M, and 1C, and can be rotated by rotationally driving the center shaft 18*a* of the rotary 18 by an unshown motor. In order to form a black toner image on the photosensitive drum 28, the rotary 18 is rotated to move the developing device 1K into the development position P1 in which the development roller of the developing device 1 is placed virtually in contact with the photosensitive drum 28, for development, whereas in order to form a toner image different in color from the toner image formed with the use of the developing device 1K, for example, a yellow toner image, the rotary 18 is rotated again to move the developing device 1Y into the development position P1, for development. The toner images different in color from the images formed by the developing devices 1K and 1Y are formed in the same manner.

A black developer supply container 16 is placed above the developing device 1K, and stores therein the black developer supply. It contains a developer stirring-conveying member 7 for conveying the developer in the developer supply container 16 toward the developer outlet 6. The developer stirring-conveying member 7 comprises a rigid shaft and plural pieces of resin film attached to the rigid shaft, so that as the rigid shaft is rotationally driven, the developer in the developer supply container 16 is conveyed toward the developer outlet 6 while being stirred. There is an unshown seal between the developer supply container 16 and developing device 1, preventing the developer from leaking.

As the black developing device 1K is moved into the development position P1, it becomes connected to an unshown driving mechanism, causing the developer stirring-conveying member 7 of the developer supply container 16 to be rotated. As the developer stirring-conveying member 7 is rotated, the developer in the developer supply container 16 is conveyed to the developer outlet 6 of the developer supply container 16, and is discharged therefrom. The discharged developer falls, due to its own weight, onto the conveyance screw 8*a*, which is being rotated. As the result, the developer is conveyed into the developing device 1K through the developer inlet 9 of the developing device 1K, the developer in which has been consumed by image formation; the developing device 1K is replenished with the developer.

The yellow, magenta, and cyan developer supply containers 17Y, 17M, and 17C are above the yellow, magenta, and cyan developing devices 1Y, 1M, and 1C, respectively, and contain yellow, magenta, and cyan developers, respectively. Each of the yellow, magenta, and cyan developer supply containers 17Y, 17M, and 17C is provided with a two sets of developer conveyance ridges 17*d* for conveying the developer in the developer supply container toward the developer outlet 6 of the container. The two sets of ridges 17*d* are on the internal surfaces of the developer supply container, being separated from each other in terms of the circumferential direction of the container. Each ridge is tilted as shown in the drawing. Therefore, as the rotary 18 is rotated, the developer in each of the yellow, magenta, and cyan developer supply containers 17Y, 17M, and 17C, respectively, is conveyed, while being stirred, by the functions of the developer conveyance ridges 17*d* in the developer supply container 17, and gravity. There is provided an unshown seal between each of the yellow, magenta, and cyan developer supply containers 17Y, 17M, and 17C, and the corresponding developing device 1, preventing the developer from leaking.

As one of the chromatic developing device 1 runs short of developer, it is replenished with chromatic developer in the following manner. That is, in order to replenish the chromatic developing device 1 with a fresh supply of developer, the rotary 18 is rotated. As the rotary 18 is rotated, the developer in each of the yellow, magenta, and cyan developer supply containers 17Y, 17M, and 17C is conveyed, while being stirred, to the developer outlet 6 of the developer supply container 17, and is discharged therefrom. The discharged developer falls, due to its own weight, onto the conveyance screw 8*a*. Then, as the conveyance screw 8*a* is rotated, the developer is conveyed into the developing device 1 through the developer inlet 9 of the developing device 1; the developing device 1 is replenished with the fresh supply of developer.

As will be evident from FIG. 6, the black developer supply container 16 is made greater in developer capacity than the yellow, magenta, and cyan developer supply containers 17Y, 17M, and 17C.

In other words, in this embodiment, not only does the black developer supply container for a multicolor image forming apparatus of the rotary type not require the rotary of the image forming apparatus to be rotated to supply the black developing device with developer, but also is enabled to store greater amount of black developer than that in the first embodiment, further improving the productivity in a black image forming operation, more specifically, a black image forming operation for continuously forming a substantial number of black images of high density, for which a multicolor image forming apparatus is used a substantially greater number of times than for color image formation.

The first and second embodiments of the present invention make it unnecessary to provide a color developer supply container with such components as a developer stirring-conveying internal member, bearings, seal, etc. that are for supplying a developing device with developer, and that add to the costs of a developer supply container and a developing device. Therefore, the first and second embodiments reduce the cost of a color developer supply container, reducing thereby the overall cost of image formation. Further, as far as a developer supply container having a developer stirring-conveying internal member is concerned, the first and second embodiments makes it unnecessary to rotate the rotary even when continuously forming a substantial number of monochromatic images of high density. Therefore, they improve image formation productivity.

The gist of the present invention is that a color developer supply container is structured to use the rotation of a rotary to convey the developer in the container, and that a black developer supply container is structured to convey the developer therein without relying on the rotation of the rotary.

In other words, the structure for using the rotation of the rotary to convey the developer in a developer supply container, or the structure for not using the rotation of the rotary to convey the developer in a developer supply container, may be different from those in the preceding embodiments. Obviously, the above described structural arrangements may be switched to one of the various well-known structural arrangements for conveying the developer in a developer supply container.

As will be evident from the descriptions of the preceding embodiments of the present invention, the present invention makes it possible to provide an image forming apparatus superior to an image forming apparatus in accordance with the prior art, in both cost, and productivity in the continuous formation of a substantial number of monochromatic images of a predetermined color.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a first developing device and a second developing device for developing an electrostatic latent image formed on an image bearing member at a developing portion;

a rotatable member supporting said first and second developing devices, said rotatable member being rotatable along a path through said developing portion; and a first developer supply container and a second developer supply container, supported on said rotatable member, for supplying developer into said first developing device and into said second developing device, wherein the developer in said first developer supply container is fed using rotation of said rotatable member, whereas the developer in said second developer supply container is fed without using rotation of said rotatable member.

2. An image forming apparatus according to claim 1, wherein said apparatus is operable in a mode in which a multi-color image is formed using said first developing device and said second developing device, and in a mode in which a monochromatic image is formed using said second developing device.

3. An image forming apparatus according to claim 2, wherein said first developing device is effective to form an image with a color developer, and said second developing device is effective to form an image with a black developer.

4. An image forming apparatus according to claim 3, further comprising an additional pair of a first developing device and a first developer supply container.

5. An image forming apparatus comprising:

a first developing device and a second developing device for developing an electrostatic latent image formed on an image bearing member at a developing portion;

a rotatable member supporting said first and second developing devices, said rotatable member being rotatable along a path through said developing portion;

a first developer supply container and a second developer supply container, substantially non-rotatably supported on said rotatable member, for supplying developer into said first developing device and into said second developing device;

a first feeding member, rotatable integrally with said first developer supply container, for feeding the developer in said first developer supply container with the rotation of said rotatable member; and a second feeding member, rotatable relative to said second developer supply container, for feeding the developer in said second developer supply container.

6. An image forming apparatus according to claim 5, wherein said apparatus is operable in a mode in which a multi-color image is formed using said first developing device and said second developing device, and in a mode in which a monochromatic image is formed using said second developing device.

7. An image forming apparatus according to claim 6, wherein said first developing device is effective to form an image with a color developer, and said second developing device is effective to form an image with a black developer.

8. An image forming apparatus according to claim 7, further comprising an additional pair of a first developing device and a first developer supply container.

9. An image forming apparatus comprising:

a plurality of developing devices for developing an electrostatic latent image formed on an image bearing member at a developing portion;

a rotatable member for supporting said developing devices and form selectively positioning said developing devices at the developing portion; and a plurality of developer supply containers provided corresponding to respective ones of said developing devices to supply the developer, wherein said apparatus is operable in a mode in which a multi-color image is formed using said plurality of developing devices, and in a mode in which a monochromatic image is formed using a predetermined one of said developing devices, and wherein the developer in said developer supply container corresponding to said developing device other than said predetermined developing device is fed using rotation of said rotatable member, whereas the developer in said developer supply container corresponding to said predetermined developing device is fed without using rotation of said rotatable member.

10. An image forming apparatus according to claim 9, wherein said predetermined developing device is effective to form a black image.

11. An image forming apparatus comprising:

a plurality of developing devices for developing an electrostatic latent image formed on an image bearing member at a developing portion;

a rotatable member for supporting said developing devices and form selectively positioning said developing devices at the developing portion;

a plurality of developer supply containers provided corresponding to respective ones of said developing devices to supply the developer, wherein said apparatus is operable in a mode in which a multi-color image is formed using said plurality of developing devices, and in a mode in which a monochromatic image is formed using a predetermined one of said developing devices;

a first feeding member, rotatable integrally with said developer supply container corresponding to said developing device other than said predetermined developing device to feed the developer in said developer supply container with rotation of said rotatable member; and a second feeding member, rotatable relative to said developer supply container corresponding to said predetermined developing device to feed the developer in said predetermined developer supply container.

12. An image forming apparatus according to claim 1, wherein said predetermined developing device is effective to form a black image.

* * * * *

UNITED STATES PATENT AND TRADEMARK OFFICE

CERTIFICATE OF CORRECTION

PATENT NO. : 6,996,359 B2
APPLICATION NO. : 10/793791
DATED : February 7, 2006
INVENTOR(S) : Tetsuro Awaya It is certified that error appears in the above-identified patent and that said Letters Patent is hereby corrected as shown below:

COLUMN 1:

Line 27, “increment” should read --increments--; and
Line 56, “the” should read --this--.

COLUMN 2:

Line 1, “containers 322” should read --containers 315--.

COLUMN 4:

Line 21, “th” should read --the--.

COLUMN 8:

Line 43, “a” should be deleted.

COLUMN 9:

Line 35, “makes” should read --make--.

COLUMN 11:

Line 2, “form” should read --for--.

UNITED STATES PATENT AND TRADEMARK OFFICE

CERTIFICATE OF CORRECTION

PATENT NO. : 6,996,359 B2
APPLICATION NO. : 10/793791
DATED : February 7, 2006
INVENTOR(S) : Tetsuro Awaya It is certified that error appears in the above-identified patent and that said Letters Patent is hereby corrected as shown below:

COLUMN 12:

Line 2, “form” should read --for--; and
Line 22, “claim 1,” should read --claim 11,--.

Signed and Sealed this

Fifteenth Day of August, 2006

JON W. DUDAS
*Director of the United States Patent and Trademark Office*